US011027563B2

(12) United States Patent
Yamashita et al.

(10) Patent No.: US 11,027,563 B2
(45) Date of Patent: Jun. 8, 2021

(54) PRINTING APPARATUS AND MEDIUM CONVEYANCE METHOD

(71) Applicant: SEIKO EPSON CORPORATION, Tokyo (JP)

(72) Inventors: Takahiro Yamashita, Matsumoto (JP); Tsutomu Sasaki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 38 days.

(21) Appl. No.: 16/354,519

(22) Filed: Mar. 15, 2019

(65) Prior Publication Data

US 2019/0283468 A1 Sep. 19, 2019

(30) Foreign Application Priority Data

Mar. 19, 2018 (JP) ..... JP2018-051039

(51) Int. Cl.

| | |
|---|---|
| ***B41J 11/04*** | (2006.01) |
| ***B41J 3/407*** | (2006.01) |
| ***B41J 11/42*** | (2006.01) |
| ***B41J 11/00*** | (2006.01) |

(52) U.S. Cl.

CPC ..... *B41J 11/04* (2013.01); *B41J 3/4078* (2013.01); *B41J 11/007* (2013.01); *B41J 11/42* (2013.01)

(58) Field of Classification Search

CPC .. B65H 2220/02; B65H 2220/01; B41J 11/42; B41J 3/4075

See application file for complete search history.

(56) References Cited

U.S. PATENT DOCUMENTS

| | | | | |
|---|---|---|---|---|
| 6,674,035 | B2 * | 1/2004 | Ito | B65H 5/06 209/563 |
| 8,919,912 | B2 * | 12/2014 | Uchida | B41J 29/393 347/101 |
| 8,979,236 | B1 * | 3/2015 | Idehara | B41J 11/36 347/104 |
| 2011/0056799 | A1 * | 3/2011 | Eoka | G07F 19/20 198/464.2 |
| 2012/0182347 | A1 * | 7/2012 | Shimizu | B41J 11/42 347/16 |
| 2014/0029023 | A1 * | 1/2014 | Yanase | G06K 15/024 358/1.6 |

(Continued)

FOREIGN PATENT DOCUMENTS

JP 2012-116093 6/2012

*Primary Examiner* — John Zimmermann
(74) *Attorney, Agent, or Firm* — Workman Nydegger

(57) ABSTRACT

Provided is a printing apparatus that includes a printing unit, a conveyance belt that is stretched over a first roller and a second roller such that a tension is applied to the conveyance belt, and a control unit configured to perform on the conveyance belt a forward rotation operation configured to convey a medium in a conveyance direction and a reverse rotation operation configured to convey the medium in a reverse conveyance direction. When the reverse rotation operation has been performed during a print pause period and the tension at the end of the print pause period has changed from the tension when printing of a first image is complete due to the reverse rotation operation performed during the print pause period, the control unit corrects a rotation amount of the conveyance belt in a first rotation direction during printing of a second image.

9 Claims, 7 Drawing Sheets

(56) References Cited

U.S. PATENT DOCUMENTS

2014/0099148 A1* 4/2014 Obata ..... B41J 3/4075
400/236.2
2014/0099150 A1* 4/2014 Matsumoto ..... B41J 13/08
400/619

* cited by examiner

PRINTING APPARATUS AND MEDIUM CONVEYANCE METHOD

BACKGROUND

1. Technical Field

The invention relates to a printing apparatus and a medium conveyance method.

2. Related Art

In related art, various printing apparatuses have been disclosed that can perform printing on a medium that is conveyed. Among those, there is a printing apparatus provided with a conveyance belt stretched over a plurality of rollers and capable of conveying the medium while supporting the medium.

For example, in JP-A-2012-116093, an ink jet-type recording apparatus is disclosed that is provided with a conveyance belt stretched over a driving roller and a driven roller and capable of conveying a recording medium.

For example, in a printing apparatus of the related art, such as the ink jet-type recording apparatus in JP-A-2012-116093, which is provided with a conveyance belt stretched over a plurality of rollers and capable of conveying a medium while supporting the medium, the conveyance belt can typically be rotated in an opposite direction to the direction in which the belt is rotated during printing (i.e., the rotation of the conveyance belt can be reversed). However, the reversal of the rotation of the conveyance belt causes variation in the tension or other properties of the conveyance belt between the rollers. This results in a change in the state of the conveyance belt. The changed state of the conveyance belt may in turn lead to a decreased conveyance accuracy of the medium.

SUMMARY

Accordingly, an object of the invention is to minimize error in a conveyance amount of a medium, which may occur as a result of rotating in reverse a conveyance belt.

A printing apparatus according to a first aspect of the invention to solve the above-described problem includes a printing unit configured to print an image on a medium conveyed in a conveyance direction, a first roller disposed upstream of the printing unit in the conveyance direction, a second roller disposed downstream of the printing unit in the conveyance direction, a conveyance belt that is stretched over the first roller and the second roller such that a tension is applied to the conveyance belt between the first roller and the second roller and that is configured to support the medium at least in a facing region facing the printing unit, and a control unit configured to perform on the conveyance belt a forward rotation operation configured to convey the medium supported by the conveyance belt in the conveyance direction by causing the conveyance belt to be rotated in a first rotation direction, and a reverse rotation operation configured to convey the medium supported by the conveyance belt in a reverse conveyance direction, which is an opposite direction to the conveyance direction, by causing the conveyance belt to be rotated in a second rotation direction, which is an opposite direction to the first rotation direction. When the reverse rotation operation has been performed during a print pause period, which is a period from when printing of a first image is complete to when printing of a second image to be printed subsequently to the first image is started, and the tension at an end of the print pause period has changed from the tension when the printing of the first image is complete due to the reverse rotation operation performed during the print pause period, the control unit corrects a rotation amount of the conveyance belt in the first rotation direction during printing of the second image.

According to this aspect, when the reverse rotation operation has been performed during the print pause period and the tension at the end of the print pause period has changed from the tension when the printing of the first image is complete due to the reverse rotation operation performed during the print pause period, the rotation amount of the conveyance belt in the first rotation direction during printing of the second image is corrected. Thus, as a result of the correction, the error in the conveyance amount of the medium M that may occur as a result of rotating in reverse the conveyance belt can be minimized.

According to a second aspect of the invention, with respect to the printing apparatus of the first aspect, the control unit is configured to determine whether the tension is at a reference value and correct the rotation amount of the conveyance belt in the first rotation direction during printing of the second image until the tension reaches the reference value.

According to this aspect, until the tension reaches the reference value, namely, during the period in which the error in the conveyance amount of the medium may occur, the rotation amount of the conveyance belt in the first rotation direction during printing of the second image is corrected. Thus, the error in the conveyance amount of the medium that may occur as a result of rotating in reverse the conveyance belt can be advantageously minimized.

According to a third aspect of the invention, with respect to the printing apparatus of the second aspect, the control unit is configured to correct the rotation amount of the conveyance belt in the first rotation direction during printing of the second image based on a difference between the tension and the reference value.

According to this aspect, based on the difference between the tension and the reference value, the rotation amount of the conveyance belt in the first rotation direction during printing of the second image is corrected. Thus, in accordance with the magnitude of deviation of the tension from the reference value, the error in the conveyance amount of the medium that may occur as a result of rotating in reverse the conveyance belt can be accurately minimized.

According to a fourth aspect of the invention, with respect to the printing apparatus of the second or third aspect, the control unit is configured to obtain a net reverse rotation amount by subtracting the rotation amount in the first rotation direction that contributes to changes in the tension of the rotation amount of the conveyance belt in the first rotation direction during the print pause period, from the rotation amount in the second rotation direction that contributes to the changes in the tension, of the rotation amount of the conveyance belt in the second rotation direction during the print pause period, and determine whether the net reverse rotation amount at the end of the print pause period is at a reverse rotation saturation amount at which the changes in the tension due to the reverse rotation operation reach saturation.

Although the appropriate correction may vary depending on whether the net reverse rotation amount at the end of the print pause period is at the reverse rotation saturation amount, according to this aspect, since whether the actual reverse rotation amount is at the reverse rotation saturation amount is determined, the rotation amount can be advantageously corrected regardless of whether the net reverse rotation amount is at the reverse rotation saturation amount.

According to a fifth aspect of the invention, with respect to the printing apparatus of the fourth aspect, when the control unit determines that the net reverse rotation amount is not at the reverse rotation saturation amount, the control unit corrects the rotation amount of the conveyance belt in the first rotation direction during printing of the second image in accordance with the net reverse rotation amount.

According to this aspect, since the rotation amount is corrected in accordance with the net reverse rotation amount when it is determined that the net reverse rotation amount is not at the reverse rotation saturation amount, the rotation amount can be advantageously corrected when it is determined that the net reverse rotation amount is not at the reverse rotation saturation amount.

According to a sixth aspect of the invention, with respect to the printing apparatus of the fourth or fifth aspect, when the control unit determines that the net reverse rotation amount is at the reverse rotation saturation amount, the control unit corrects the rotation amount of the conveyance belt in the first rotation direction during printing of the second image by a predetermined amount corresponding to the reverse rotation saturation amount.

According to this aspect, since the rotation amount is corrected by the predetermined amount corresponding to the reverse rotation saturation amount when it is determined that the net reverse rotation amount is at the reverse rotation saturation amount, the rotation amount can be advantageously corrected when it is determined that the net reverse rotation amount is at the reverse rotation saturation amount.

According to a seventh aspect of the invention, with respect to the printing apparatus of any one of the first to sixth aspects, the second roller is a driving roller rotationally driven by a motor, the first roller is a driven roller rotated in accordance with the rotation of the conveyance belt caused by the rotational drive of the second roller, the control unit causes the conveyance belt to rotate by causing the second roller to be rotationally driven, and when the tension at the end of the print pause period has changed from the tension when the printing of the first image is complete due to the reverse rotation operation performed during the print pause period, the control unit performs correction to reduce the rotation amount of the conveyance belt in the first rotation direction during printing of the second image.

When the roller on the downstream side in the conveyance direction is the driving roller, as a result of the conveyance belt being rotated in reverse during the print pause period, the tension tends to decrease, and when the medium is conveyed to print the second image, the conveyance amount tends to increase. According to this aspect, by performing the correction so as to reduce the rotation amount, it is possible to prevent the medium from being conveyed by more than an appropriate amount during printing of the second image.

According to an eighth aspect of the invention, with respect to the printing apparatus of any one of the first to sixth aspects, the first roller is a driving roller rotationally driven by a motor, the second roller is a driven roller rotated in accordance with the rotation of the conveyance belt caused by the rotational drive of the first roller, the control unit causes the conveyance belt to rotate by causing the first roller to be rotationally driven, and when the tension at the end of the print pause period has changed from the tension when the printing of the first image is complete due to the reverse rotation operation performed during the print pause period, the control unit performs correction to increase the rotation amount of the conveyance belt in the first rotation direction during printing of the second image.

When the roller on the upstream side in the conveyance direction is the driving roller, as a result of the conveyance belt 5 being rotated in reverse during the print pause period, the tension tends to increase, and when the medium is conveyed to print the second image, the conveyance amount tends to decrease. According to this aspect, by performing the correction so as to increase the rotation amount, it is possible to prevent the medium from being conveyed by less than the appropriate amount when printing the second image.

A medium conveyance method according to a ninth aspect of the invention is a medium conveyance method in a printing apparatus that includes a printing unit configured to print an image on a medium conveyed in a conveyance direction, a first roller disposed upstream of the printing unit in the conveyance direction, a second roller disposed downstream of the printing unit in the conveyance direction, and a conveyance belt that is stretched over the first roller and the second roller such that a tension is applied to the conveyance belt between the first roller and the second roller and that is configured to support the medium at least in a facing region facing the printing unit. The printing apparatus is configured to perform on the conveyance belt a forward rotation operation configured to convey the medium supported by the conveyance belt in the conveyance direction by causing the conveyance belt to be rotated in a first rotation direction, and a reverse rotation operation configured to convey the medium supported by the conveyance belt in a reverse conveyance direction, which is an opposite direction to the conveyance direction, by causing the conveyance belt to be rotated in a second rotation direction, which is an opposite direction to the first rotation direction. The medium conveyance method includes correcting a rotation amount of the conveyance belt in the first rotation direction during printing of a second image, when the reverse rotation operation has been performed during a print pause period, which is a period from when printing of a first image is complete to when printing of the second image to be printed subsequently to the first image is started, and the tension at an end of the print pause period has changed from the tension when the printing of the first image is complete due to the reverse rotation operation performed during the print pause period.

According to this aspect, when the reverse rotation operation has been performed during the print pause period and the tension at the end of the print pause period has changed from the tension when the printing of the first image is complete due to the reverse rotation operation performed during the print pause period, the rotation amount of the conveyance belt in the first rotation direction during printing of the second image is corrected. Thus, as a result of the correction, the error in the conveyance amount of the medium that may occur as a result of rotating in reverse the conveyance belt can be minimized.

BRIEF DESCRIPTION OF THE DRAWINGS

The invention will be described with reference to the accompanying drawings, wherein like numbers reference like elements.

DESCRIPTION OF EXEMPLARY EMBODIMENTS

A printing apparatus according to an embodiment of the invention will now be described in detail with reference to the appended drawings.

First, an overview of a printing apparatus 1 according to an embodiment of the invention will be described.

Figure 1:
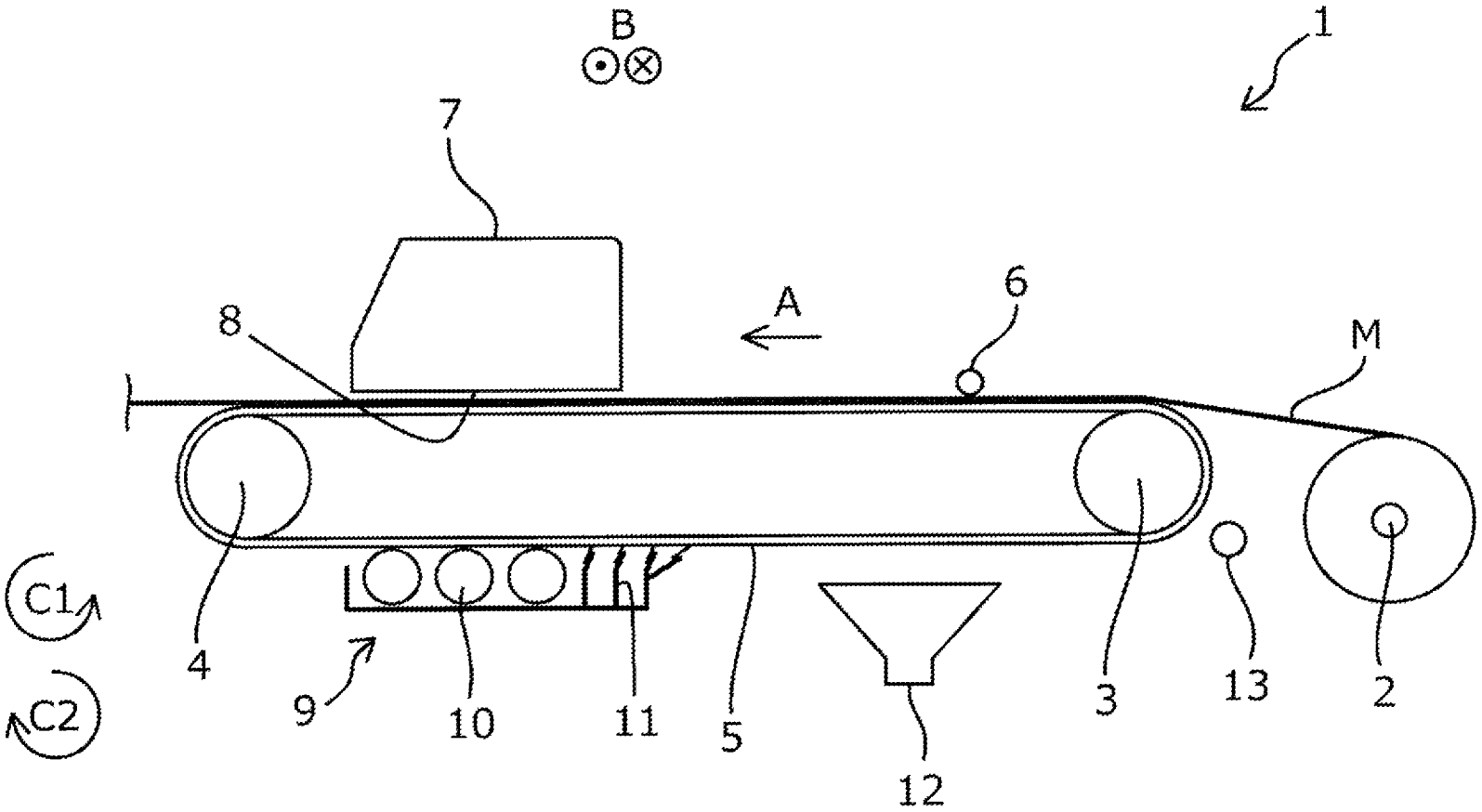
FIG. 1 is a schematic side view illustrating a printing apparatus according to an embodiment of the invention.

FIG. 1 is a schematic perspective view illustrating the printing apparatus 1 according to the present embodiment.

As illustrated in FIG. 1, the printing apparatus 1 of the present embodiment includes a setting unit 2 in which a roll-type medium M is set. Further, the printing apparatus 1 includes a conveyance unit capable of conveying the medium M fed from the setting unit 2 in a conveyance direction A. The conveyance unit includes a driven roller 3 that is positioned on an upstream side in the conveyance direction A, as a first roller, a driving roller 4 that is positioned on a downstream side in the conveyance direction A, as a second roller, and a conveyance belt 5 that is an endless belt stretched over the driven roller 3 and the driving roller 4.

Here, the conveyance belt 5 is an adhesive belt, on the outer surface of which an adhesive is applied. As illustrated in FIG. 1, the medium M is conveyed while being supported by the conveyance belt 5 with the medium M attached to the outer surface of the adhesive belt on which the adhesive is applied. A support region of the medium M on the conveyance belt 5 is an upper region of the conveyance belt 5 that stretches between the driven roller 3 and the driving roller 4. Further, the driving roller 4 is a roller that is rotated by the driving force of a conveyance motor 22 (see FIG. 2), while the driven roller 3 is a roller that rotates following the rotation of the conveyance belt 5 caused by the rotation of the driving roller 4.

In addition, the printing apparatus 1 includes a carriage 7 and a printing head 8 attached to the carriage 7. The printing head 8 functions as a printing unit capable of printing an image on the medium M conveyed in the conveyance direction A. The printing head 8 is arranged at a position facing the support region of the medium M on the conveyance belt 5 and can discharge ink. At this time, it can be said that the support region of the medium M on the conveyance belt 5 is a facing region that faces the printing head 8. The printing apparatus 1 of the present embodiment can print the image by discharging the ink from the printing head 8 onto the medium M that is conveyed, while causing the carriage 7 to reciprocate in a scanning direction B that intersects with the conveyance direction A. With the carriage 7 having such a configuration, the printing apparatus 1 of the embodiment can form a desired image on the medium M by alternating between conveying the medium M in the conveyance direction A by a predetermined conveyance amount and discharging ink while the carriage 7 is moved along the scanning direction B with the medium M stopped.

Note that although the printing apparatus 1 of the present embodiment is a so-called serial printer that performs printing by alternating between the conveyance of the medium M by a predetermined amount and the scanning (reciprocation) of the carriage 7, the printing apparatus 1 of the present embodiment may be a so-called line printer that continuously performs the printing while continuously conveying the medium M by using a line head having nozzles formed in a line along the width direction of the medium M. Further, the printing apparatus 1 of the present embodiment may include a recording unit having a different configuration from that of a so-called ink jet-type recording unit that performs recording by discharging ink.

Further, a medium attaching unit 6 is arranged at a position upstream to the carriage 7 in the conveyance direction A and facing the conveyance belt 5. With the medium attaching unit 6 pressing the medium M against the conveyance belt 5 over the width direction of the medium M (the direction along the scanning direction B), the medium M is attached to the conveyance belt 5 while minimizing occurrences of wrinkles and the like.

After the medium M with the formed image is discharged from the printing apparatus 1 of the embodiment, it is sent to a drying device (a device that evaporates components of the ink discharged onto the medium M), a winding device (a device that takes up the medium M with the formed image) or other devices that are provided at a later stage than the printing apparatus 1 of the present embodiment.

Here, a printable material can be preferably used as the medium M. The term "printable material" refers to a fabric, a garment, and other clothing products which can be printed. Fabrics include natural fibers, such as cotton, silk and wool, chemical fibers, such as nylon, or composite fibers of natural fibers and chemical fibers, such as woven cloths, knit fabrics and non-woven cloths. Garments and other clothing products include sewn products, such as a T-shirt, handkerchief, scarf, towel, handbag, fabric bag, and furniture-related products including a curtain, sheet, and bed cover, as well as fabric before and after cutting to serve as parts before sewing.

Further, in addition to the above-described printable material, the medium M may be special paper for ink-jet recording, such as plain paper, pure paper and glossy paper. In addition, other materials that can be used as the medium M include, for example, plastic films on which no surface treatment is applied, namely, no ink absorption layer is formed for ink-jet printing, as well as substrates made of paper and the like on which a plastic coating is applied or to which a plastic film is bonded. Such plastic materials include, but are not limited to, for example, polyvinyl chloride, polyethylene terephthalate, polycarbonate, polystyrene, polyurethane, polyethylene, and polypropylene.

When the printable material is used as the medium M, the conveyance belt 5 may be stained by the ink since the printable material is susceptible to bleed-through, a phenomenon in which the ink discharged onto the medium M seeps through to the back surface. Thus, the printing apparatus 1 of the present embodiment includes a cleaning unit 9 for cleaning the ink that remains on the conveyance belt 5 as a result of the bleed-through. The cleaning unit 9 of the present embodiment includes three cleaning brushes 10 that are soaked with a cleaning liquid and come into contact with the conveyance belt 5 and four wipers 11 that wipe off the cleaning liquid that attaches to the conveyance belt 5 when the cleaning brushes 10 are brought into contact with the conveyance belt 5. In addition, the cleaning unit 9 of the present embodiment is configured to be able to move in a direction away from the conveyance belt 5.

Further, the printing apparatus 1 of the present embodiment includes a drying unit that can dry the cleaning liquid that the wipers 11 have not managed to wipe off. The drying unit includes a heating unit 12 that heats the conveyance belt 5 and an air-blowing unit 13 that blows air onto the conveyance belt 5.

The printing apparatus 1 of the present embodiment can convey the medium M in the conveyance direction A by rotating the driving roller 4 in a rotation direction C1. In addition, the printing apparatus 1 can also convey in reverse the medium M in a direction opposite to the conveyance direction A by rotating the driving roller 4 in a rotation direction C2, which is an opposite direction to the rotation direction C1. In the present embodiment, a rotation in the rotation direction C1 is defined as a forward rotation and a rotation in the rotation direction C2 is defined as a reverse rotation. Then, an operation of conveying the medium M in the conveyance direction A by rotating the driving roller 4 in the rotation direction C1 is referred to as a forward rotation operation, and an operation of conveying in reverse the medium M in the opposite direction to the conveyance direction A by rotating the driving roller 4 in the rotation direction C2, which is the opposite direction to the rotation direction C1, is referred to as a reverse rotation operation. In other words, the printing apparatus 1 can perform the forward rotation operation and the reverse rotation operation. Note that the printing apparatus 1 of the present embodiment is not only capable of rotating the driving roller 4 in the rotation direction C1 and the rotation direction C2 while the medium M is supported by the conveyance belt 5, but is also capable of rotating the driving roller 4 in the rotation direction C1 and the rotation direction C2 while the medium M is not supported by the conveyance belt 5.

The electrical configuration of the printing apparatus 1 according to the present embodiment will be described next.

Figure 2:
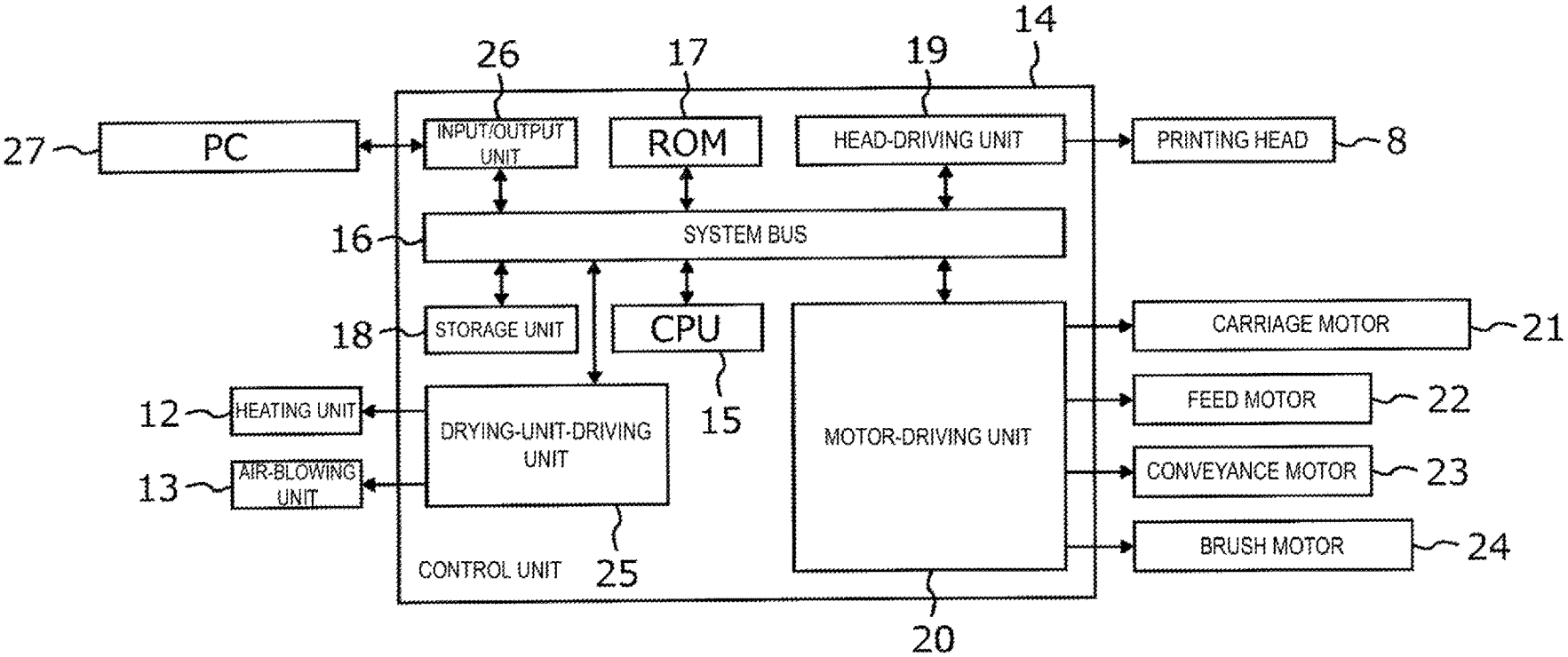
FIG. 2 is a block diagram illustrating the printing apparatus according to an embodiment of the invention.

FIG. 2 is a block diagram illustrating the printing apparatus 1 of the present embodiment.

In a control unit 14, a CPU 15 that performs an overall control of the printing apparatus 1 is provided. The CPU 15 is connected, via a system bus 16, to a ROM 17 that stores various control programs and the like that are executed by the CPU 15, and to a storage unit 18 (a memory such as a RAM and an EEPROM) that can temporarily store data.

In addition, the CPU 15 is connected, via the system bus 16, to a head-driving unit 19 that drives the printing head 8 (i.e., causes it to discharge the ink).

Further, the CPU 15 is connected, via the system bus 16, to a motor driving unit 20 that is connected to a carriage motor 21, the conveyance motor 22, a feed motor 23, and a brush motor 24.

Here, the carriage motor 21 is a motor for moving the carriage 7 mounted on the printing head 8 in the scanning direction B. The conveyance motor 22 is a motor for driving the driving roller 4. Further, the feed motor 23 is a rotary mechanism of the setting unit 2 and is a motor that drives the setting unit 2 so as to feed the medium M to the conveyance belt 5. Then, the brush motor 24 is a driving motor for rotating the cleaning brushes 10.

In addition, the CPU 15 is connected, via the system bus 16, to a drying-unit-driving unit 25 that is connected to the heating unit 12 and the air-blowing unit 13.

Further, the CPU 15 is connected, via the system bus 16, to an input/output unit 26 that is connected to a PC 27 that receives and sends data, such as image data, and signals.

With such a configuration, the control unit 14 of the present embodiment can control the discharge of the ink from the printing head 8, the scanning (reciprocation) of the carriage 7, the movement of the conveyance belt 5 (the conveyance of the medium M), and the like. Further, the control unit 14 is configured so as to be able to cause the storage unit 18 to record (store) a rotation trajectory of the conveyance motor 22 during a predetermined period such as a print pause period, which is a period from when printing of a first image is complete to when printing of a second image printed subsequently to the first image is started. Then, on the basis of the rotation trajectory, the control unit 14 determines whether or not the reverse rotation operation has been performed during the print pause period, which is the period lasting from the completion of printing of the first image to the start of the printing of the second image to be printed subsequently to the first image. Then, if the belt tension (the tension acting on the conveyance belt 5) at the end of the print pause period has changed from the completion of printing of the first image as a result of the reverse rotation operation performed during the print pause period, then the control unit 14 corrects the rotation amount of the conveyance belt 5 in the first rotation direction during printing of the second image. By performing such a correction, an error in the conveyance amount of the medium M that may occur as a result of rotating in reverse the conveyance belt 5 can be minimized.

Further, if the reverse rotation operation has not been performed during the print pause period, or if the reverse rotation operation has been performed during the print pause period but the belt tension at the end of the print pause period has not changed from the completion of the printing of the first image, the control unit 14 does not perform the correction of the rotation amount of the conveyance belt 5 during printing of the second image. Note that the case in which "if the reverse rotation operation has been performed during the print pause period but the belt tension at the end of the print pause period has not changed from the completion of the printing of the first image" will be described below.

Specifically, the control unit 14 is configured so as to be able to determine, on the basis of the rotation trajectory, the difference in the rotation amounts during the print pause period between the rotation amount of the conveyance belt 5 in the first rotation direction (the rotation direction C1) caused by the forward rotation operation of the medium M and the rotation amount of the conveyance belt 5 in the second rotation direction (the rotation direction C2) caused by the reverse rotation operation.

As described above, although the printing apparatus 1 of the present embodiment is a so-called serial printer that performs printing by alternating between the conveyance of the medium M by the predetermined amount (intermittent conveyance) and the scanning of the carriage 7, the conveyance amount corresponding to a single intermittent conveyance is controlled by the control unit 14 controlling the rotation amount of the conveyance motor 22. Here, given that the rotation amount of the conveyance motor 22 corresponding to the single intermittent conveyance is always constant, if the conveyance belt 5 is first rotated in the first rotation direction (the rotation direction C1: a rotation direction that causes the forward rotation, namely, causes the medium M to be conveyed in the conveyance direction A), then in the second rotation direction (the rotation direction C2: the rotation direction that causes the reverse rotation and is the opposite direction to the rotation direction C1), and then once more in the first rotation direction, the conveyance amount of the medium M corresponding to the one intermittent conveyance will change. Reasons for this will be described below.

Figure 3:
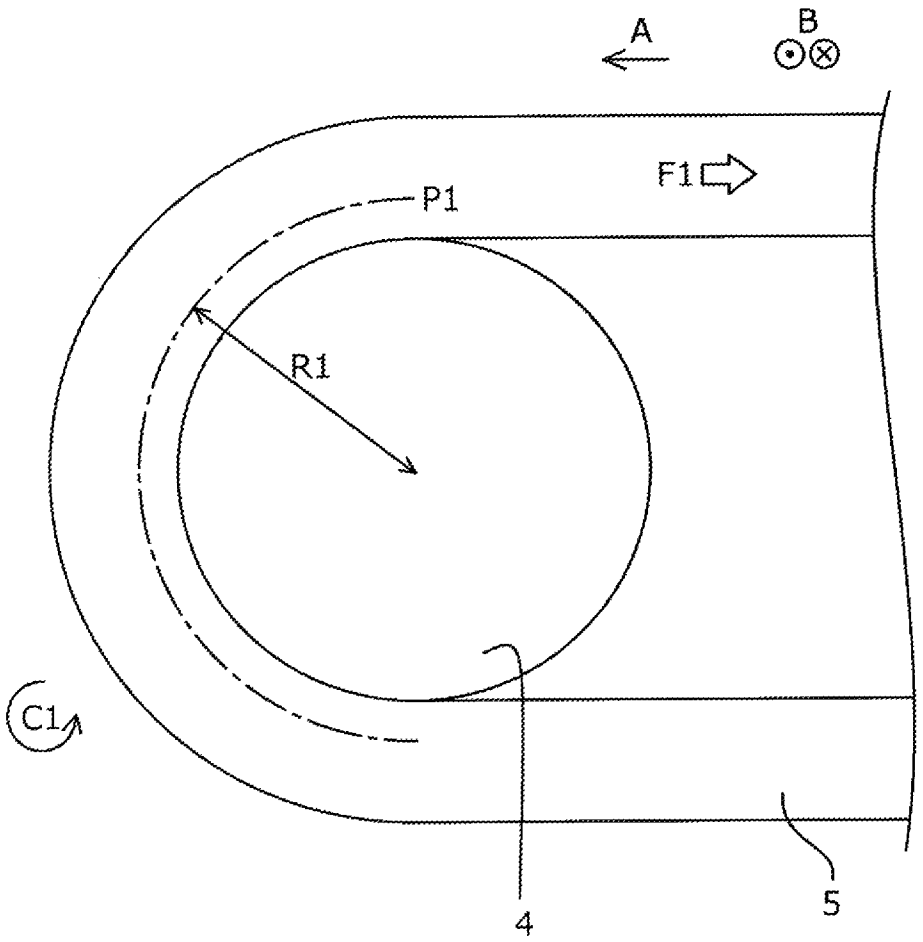
FIG. 3 is a schematic side view for describing the invention.

Here, FIG. 3 is a schematic side view illustrating a peripheral section of the driving roller 4 and depicts a state resulting after the conveyance belt 5 has been intermittently rotated in the first rotation direction for a while (until the condition of the conveyance belt 5 becomes stable). By rotating the driving roller 4 in the rotation direction C1, a state results in which an upper part of the conveyance belt 5 is being pulled in a direction F1. In this state, when the driving roller 4 (the conveyance motor 22) is rotated by a predetermined amount corresponding to the single intermittent conveyance, the conveyance belt 5 is rotated in the rotation direction C1 by an amount obtained by multiplying the radius of rotation R1 extending from the center of rotation of the driving roller 4 to a neutral plane (a position that serves as a point of application in the thickness direction of the conveyance belt 5) P1 of the conveyance belt 5 by the predetermined rotation amount of the driving roller 4.

Figure 4:
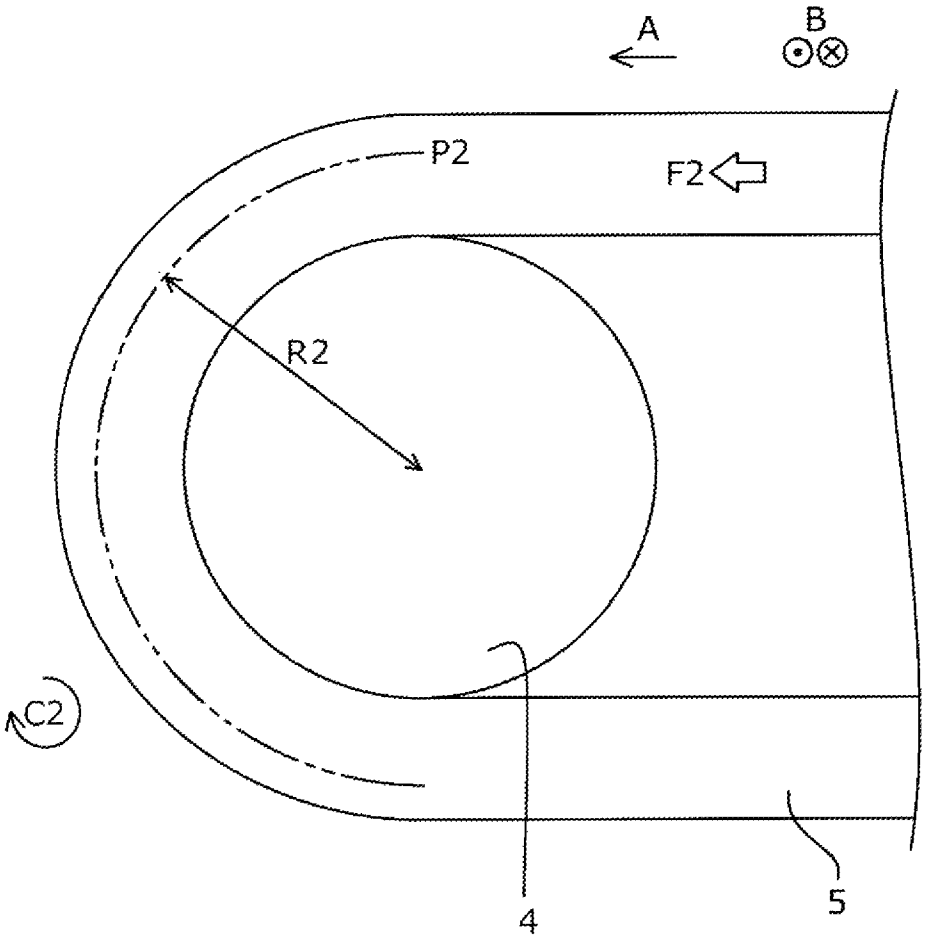
FIG. 4 is a schematic side view for describing the invention.

Similar to FIG. 3, FIG. 4 is a schematic side view illustrating the peripheral section of the driving roller and depicts a state in which the conveyance belt 5 has been intermittently rotated in the second rotation direction from the state illustrated in FIG. 3. By rotating the driving roller 4 in the rotation direction C2, a state results in which the upper part of the conveyance belt 5 is being pushed in a direction F2. In the state illustrated in FIG. 4, as a result of the belt tension becoming smaller, the radius of rotation R2 extending from the center of rotation of the driving roller 4 to a neutral plane P2 of the conveyance belt 5 accordingly becomes larger than the radius of rotation R1 illustrated in FIG. 3. In this state (the state in which the belt tension has become smaller), when the driving roller 4 (the conveyance motor 22) is rotated by the predetermined amount corresponding to the single intermittent conveyance, the conveyance belt 5 is rotated in the rotation direction C1 by an amount that is obtained by multiplying the radius of rotation R2 extending from the center of rotation of the driving roller 4 to the neutral plane P2 of the conveyance belt 5 by the predetermined rotation amount of the driving roller 4. Specifically, in the state illustrated in FIG. 4, if the driving roller 4 is rotated by the same rotation amount as in the state illustrated in FIG. 3, the rotation amount of the conveyance belt 5 (in other words, the conveyance amount of the medium M) becomes larger than the rotation amount in the state illustrated in FIG. 3.

Note that given that the radius of the driving roller 4 is r, the thickness of the conveyance belt 5 is a, the belt tension is T, the Poisson's ratio is γ, the Young's modulus is E, and a cross-section area of the conveyance belt 5 when the conveyance belt 5 is cut in the width direction is A, then the radius of rotation R (corresponding to the above-described radius of rotation R1 and the radius of rotation R2) can be expressed as follows:

$$R=r+(a/2)\cdot(1-((\gamma\cdot T)/(E\cdot A))$$

Figure 5:
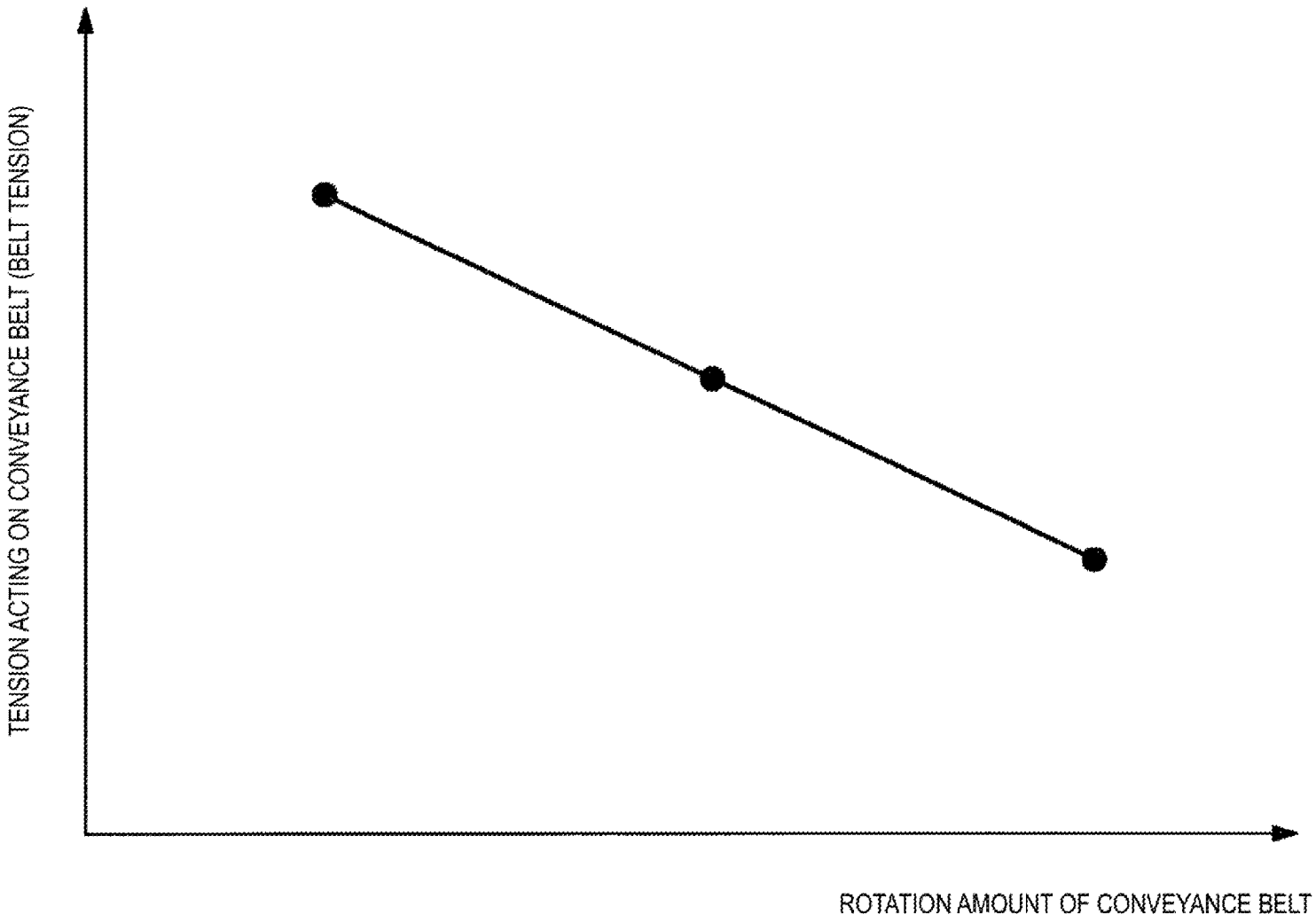
FIG. 5 is a graph depicting a relationship between a tension acting on a conveyance belt when a driving roller is rotated by a predetermined amount and a movement amount of the conveyance belt.

Here, FIG. 5 is a graph with a vertical axis indicating the belt tension and a horizontal axis indicating the rotation amount of the conveyance belt 5 when the driving roller 4 is rotated by the predetermined amount corresponding to the single intermittent conveyance. As illustrated in FIG. 5, the rotation amount of the conveyance belt 5 (in other words, the conveyance amount of the medium M) increases as the belt tension decreases. As described above with reference to FIG. 3 and FIG. 4, this is because the conveyance belt 5 becomes increasingly loose and the radius of rotation, which is the distance from the center of rotation of the driving roller 4 to the neutral plane of the conveyance belt 5, increases as the belt tension decreases.

Figure 6:
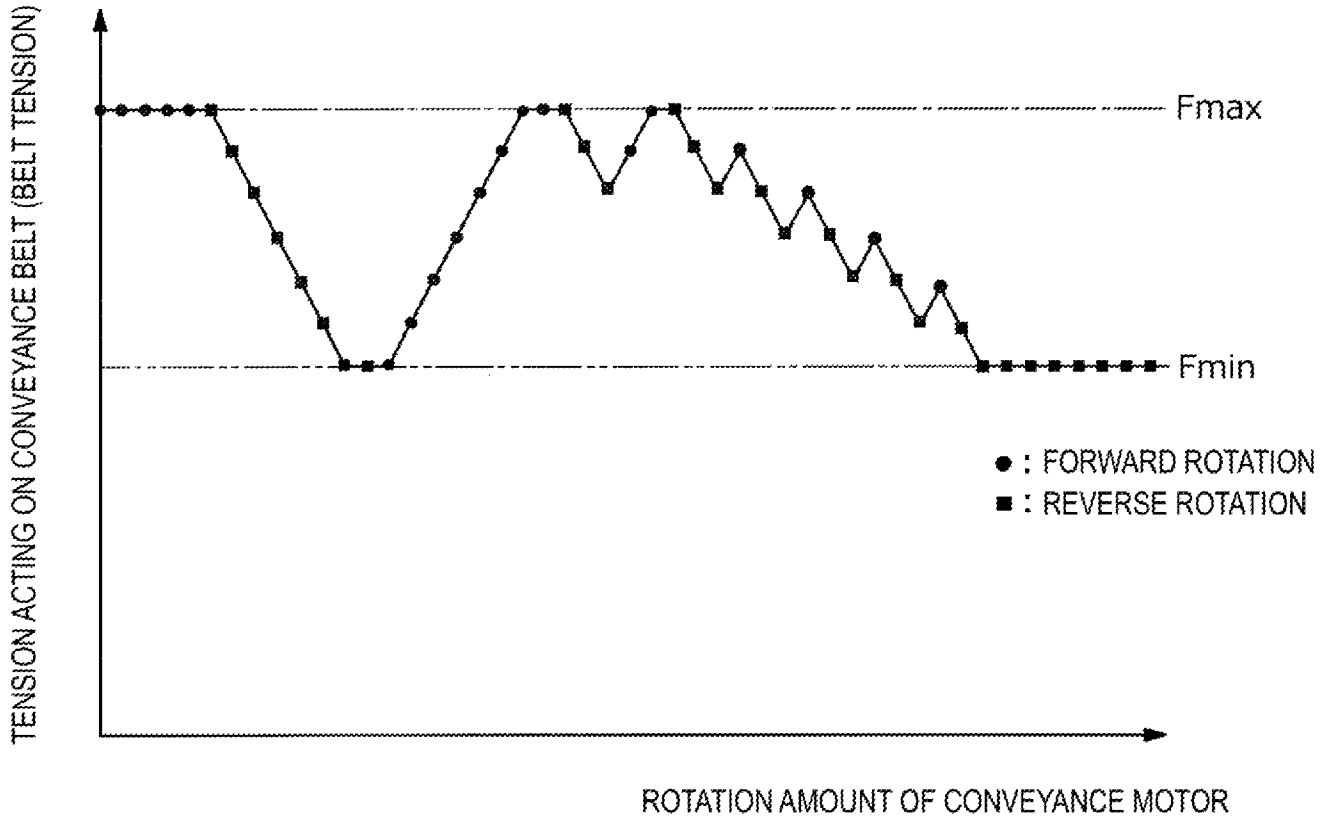
FIG. 6 is a graph depicting changes in the tension acting on the conveyance belt when a conveyance motor is rotated forward and rotated in reverse.

Further, FIG. 6 illustrates an example of changes in the belt tension caused by the forward rotation and the reverse rotation of the conveyance motor 22 (the driving roller 4). The horizontal axis indicates the rotation amount of the conveyance motor 22 whereas the vertical axis indicates the belt tension. Note that the horizontal axis indicates absolute values of the rotation amount of the conveyance motor 22. The symbol "•" in FIG. 6 indicates the rotation (the forward rotation) in the first rotation direction corresponding to the single intermittent conveyance and the symbol "■" indicates the rotation (the reverse rotation) in the second rotation direction corresponding to the one intermittent conveyance.

As illustrated in FIG. 6, when the conveyance belt 5 is intermittently rotated in the first rotation direction for a while (until the condition of the conveyance belt 5 becomes stable), the belt tension becomes stable at Fmax. On the other hand, when the conveyance belt 5 is intermittently rotated in the second rotation direction from the state in which the belt tension is at Fmax, the belt tension decreases to as low as Fmin. Within a range from Fmax to Fmin, the belt tension gradually increases when the conveyance belt 5 is intermittently rotated in the first rotation direction, whereas the belt tension gradually decreases when the conveyance belt 5 is intermittently rotated in the second rotation direction. Note that FIG. 6 illustrates a state in which the conveyance belt 5 is first rotated forward, then rotated in reverse until the belt tension reaches Fmin, then rotated forward until the belt tension reaches Fmax, and subsequently, the reverse rotation and the forward rotation of the conveyance belt 5 are intermittently repeated until the belt tension reaches Fmin.

As described above, the conveyance amount of the medium M corresponding to the single intermittent conveyance changes in accordance with the belt tension. Thus, in order to reduce the effect that the changes in the belt tension have on the conveyance amount of the medium M corresponding to the single intermittent conveyance, the printing apparatus 1 of the embodiment is configured so as to be able to correct the rotation amount of the conveyance belt 5 corresponding to the single intermittent conveyance on the basis of the difference in the rotation amount during the print pause period between the rotation amount of the conveyance belt 5 (in detail, the driving roller 4, and in more detail, the conveyance motor 22) in the first rotation direction and the rotation amount in the second rotation direction.

Note that the conveyance belt 5 is rotated in reverse because the space between the first image and the second image in the conveyance direction A needs to be narrowed (a margin region created between the first image and the second image needs to be reduced) and because the conveyance belt 5 needs to be returned to a wipeable position such that the cleaning liquid can be wiped by the wipers 11 when the cleaning liquid is attached to a position on the conveyance belt 5 beyond the position wipeable by the wipers 11 in the rotation direction C1. However, the conveyance belt 5 may be rotated in reverse for any other reasons that are not particularly limited.

Here, to summarize the description above so far, the printing apparatus 1 of the embodiment includes the printing head 8 that can print the image on the medium M conveyed in the conveyance direction A, the driven roller 3 disposed upstream to the printing head 8 in the conveyance direction A, the driving roller 4 disposed downstream to the printing head 8 in the conveyance direction A, and the conveyance belt 5 that is stretched over the driven roller 3 and the driving roller 4 such that the tension applies to the conveyance belt 5 between the driven roller 3 and the driving roller 4 and that can support the medium M at least in the facing region (the support region of the medium M) that faces the printing head 8. Further, the printing apparatus 1 includes the control unit 14 that can perform, with respect to the conveyance belt 5, the forward rotation operation that can convey the medium M supported by the conveyance belt 5 in the conveyance direction A by rotating (rotating forward) the conveyance belt 5 in the first rotation direction, and the reverse rotation operation that can convey the medium M supported by the conveyance belt 5 in a reverse conveyance direction, which is the direction opposite to the conveyance direction A, by rotating (rotating in reverse) the conveyance belt 5 in the second rotation direction, which is the direction opposite to the first rotation direction.

Here, the control unit 14 determines whether or not the reverse rotation operation has been performed during the print pause period, which is the period lasting from the completion of printing of the first image to the start of printing of the second image to be printed subsequently to the first image. When the control unit 14 determines that the reverse rotation operation has been performed during the print pause period, the control unit 14 determines the belt tension in the facing region on the basis of operation timings of the forward rotation operation and the reverse rotation operation during the print pause period, which is the period lasting from the completion of printing of the first image to the start of printing of the second image to be printed subsequently to the first image, and on the basis of the difference in the rotation amounts between the rotation amount of the conveyance belt 5 in the first rotation direction caused by the forward rotation operation and the rotation amount of the conveyance belt 5 in the second rotation direction caused by the reverse rotation operation. Then, on the basis of the belt tension, the control unit 14 corrects the rotation amount of the conveyance belt 5 in the first rotation direction during printing of the second image.

In other words, if the reverse rotation operation has been performed during the print pause period, which is the period lasting from the completion of printing of the first image to the start of printing of the second image to be printed subsequently to the first image, and the tension at the end of the print pause period has changed from the tension at the completion of printing of the first image due to the reverse rotation operation performed during the print pause period, then the control unit 14 corrects the rotation amount of the conveyance belt 5 in the first rotation direction during printing of the second image.

In this way, if the control unit 14 of the present embodiment determines that the tension of the conveyance belt 5 has changed during the print pause period, the control unit 14 corrects the rotation amount of the conveyance belt 5 in the first rotation direction during printing of the second image. Thus, as a result of the correction, the error in the conveyance amount of the medium M that may occur as a result of rotating in reverse the conveyance belt 5 can be minimized.

Here, the "first image" and the "second image" may not only be images based on different image data, but may also be two images separately formed based on the same image data.

In addition, the control unit 14 of the present embodiment determines whether or not the belt tension in the facing region is at Fmax, which is used as a reference value (a value that doesn't require correction of the rotation amount), and corrects the rotation amount of the conveyance belt 5 in the first rotation direction during printing of the second image until the belt tension reaches Fmax. In this way, until the belt tension reaches Fmax, namely, during the period in which the error in the conveyance amount of the medium M may occur, the control unit 14 corrects the rotation amount of the conveyance belt 5 in the first rotation direction during printing of the second image. Thus, the printing apparatus 1 of the present embodiment can advantageously minimize the error in the conveyance amount of the medium M that may occur as a result of rotating in reverse the conveyance belt 5.

Further, the control unit 14 of the present embodiment corrects the rotation amount of the conveyance belt 5 in the first rotation direction during printing of the second image on the basis of the difference between the belt tension and Fmax until the belt tension reaches Fmax. The appropriate correction amount varies depending on the extent of the difference between the belt tension and Fmax. Specifically, when the belt tension is closer to Fmax, the appropriate correction amount becomes smaller, while when the belt tension is further away from Fmax, the appropriate correction amount becomes larger. Thus, in accordance with the magnitude of deviation of the belt tension from Fmax, the printing apparatus 1 of the present embodiment can accurately minimize the error in the conveyance amount of the medium M that may occur as a result of rotating in reverse the conveyance belt 5.

Further, the control unit 14 of the present embodiment calculates the net reverse rotation amount by subtracting the rotation amount in the first rotation direction that contributes to the changes in the belt tension, of the rotation amount of the conveyance belt 5 in the first rotation direction during the print pause period, from the rotation amount in the second rotation direction that contributes to the changes in the belt tension, of the rotation amount of the conveyance belt 5 in the second rotation direction during the print pause period. In the present embodiment, this net reverse rotation amount is used as the above-described difference in the rotation amounts. Then, by using the net reverse rotation amount, the control unit 14 corrects the rotation amount of the conveyance belt 5 in the first rotation direction during printing of the second image. This is because some of the rotation of the conveyance belt 5 does not contribute to the changes in the belt tension. Details will be described below.

As illustrated in FIG. 6, the belt tension does not increase above Fmax, nor does it decrease below Fmin. For example, if the forward rotation operation is performed when the belt tension is at Fmax, the belt tension will not change. Thus, when the belt tension is at Fmax, it can be said that the rotation amount of the conveyance belt 5 is at a forward rotation saturation amount. If the forward rotation operation is performed when the rotation amount of the conveyance belt 5 is at the forward rotation saturation amount, the rotation amount of the conveyance belt 5 in the first rotation direction caused by this forward rotation operation does not contribute to the changes in the belt tension. Thus, the rotation amount of the conveyance belt 5 in the first rotation direction while the belt tension is at Fmax is ignored in the calculation of the difference in the rotation amounts (the net reverse rotation amount). In addition, if the reverse rotation operation is performed when the belt tension is at Fmin, the belt tension will not change. Thus, when the belt tension is at Fmin, it can be said that the rotation amount of the conveyance belt 5 is at a reverse rotation saturation amount.

If the reverse rotation operation is performed when the rotation amount of the conveyance belt 5 is at the reverse rotation saturation amount, the rotation amount of the conveyance belt 5 in the second rotation direction caused by this reverse rotation operation does not contribute to the changes in the belt tension. Thus, the rotation amount of the conveyance belt 5 in the second rotation direction while the belt tension is at Fmin is ignored in the calculation of the difference in the rotation amounts (the net reverse rotation amount), In this way, the control unit 14 calculates the difference in the rotation amounts (the net reverse rotation amount) by taking into account only the rotation amount of the conveyance belt 5 that contributes to the changes in the belt tension during the print pause period.

Then, the control unit 14 determines whether or not the net reverse rotation amount at the end of the print pause period is at the reverse rotation saturation amount (the rotation amount at which the changes in the belt tension caused by the reverse rotation operation reach saturation). Although the appropriate correction may vary depending on whether or not the net reverse rotation amount at the end of the print pause period is at the reverse rotation saturation amount, the control unit 14 can advantageously correct the rotation amount regardless of whether or not the net reverse rotation amount is at the reverse rotation saturation amount since the control unit 14 of the present embodiment determines whether or not the net reverse rotation amount is at the reverse rotation saturation amount.

To summarize the above-described operations, it can be said that the control unit 14 calculates the net reverse rotation amount (the difference in the rotation amounts) by subtracting the rotation amount in the first rotation direction that contributes to the changes in the belt tension, of the rotation amount of the conveyance belt 5 in the first rotation direction during the print pause period, from the rotation amount in the second rotation direction that contributes to the changes in the belt tension, of the rotation amount of the conveyance belt 5 in the second rotation direction during the print pause period, and determines whether or not the net reverse rotation amount at the end of the print pause period is at the reverse rotation saturation amount, at which the changes in the belt tension caused by the reverse rotation operation reach saturation.

Here, if the control unit 14 determines that the net reverse rotation amount (the difference in the rotation amounts) is not at the reverse rotation saturation amount, the control unit 14 corrects the rotation amount of the conveyance belt 5 in the first rotation direction during printing of the second image in accordance with the net reverse rotation amount. Thus, when it is determined that the net reverse rotation amount is not at the reverse rotation saturation amount, the printing apparatus 1 of the present embodiment can advantageously correct the rotation amount.

On the other hand, if the control unit 14 determines that the net reverse rotation amount (the difference in the rotation amounts) is at the reverse rotation saturation amount, the control unit 14 corrects the rotation amount of the conveyance belt 5 in the first rotation direction during printing of the second image by a predetermined amount corresponding to the reverse rotation saturation amount. Thus, when it is determined that the net reverse rotation amount is at the reverse rotation saturation amount, the printing apparatus 1 of the present embodiment can advantageously correct the rotation amount.

Further, as described above, in the printing apparatus 1 of the present embodiment, the second roller disposed downstream to the printing head 8 in the conveyance direction A is the driving roller 4 that is rotationally driven by the conveyance motor 22, whereas the first roller disposed upstream to the printing head 8 in the conveyance direction A is the driven roller 3 that rotates in accordance with the rotation of the conveyance belt 5 caused by the rotational drive of the driving roller 4. The control unit 14 rotates the conveyance belt 5 by rotationally driving the driving roller 4 and if the belt tension at the end of the print pause period has changed from the belt tension at the completion of printing of the first image due to the reverse rotation operation performed during the print pause period, the control unit 14 performs the correction so as to reduce the rotation amount of the conveyance belt 5 in the first rotation direction during printing of the second image. When the roller on the downstream side in the conveyance direction A is the driving roller, as a result of the conveyance belt 5 being rotated in reverse during the print pause period, the belt tension tends to decrease and the conveyance amount tends to increase as the medium M is conveyed to print the second image. Thus, with such a configuration, by performing the correction so as to reduce the rotation amount of the conveyance belt 5 in the first rotation direction during printing of the second image, it is possible to prevent the medium M from being conveyed by more than the appropriate amount during printing of the second image.

Note that the positions of the driving roller 4 and the driven roller 3 may be switched. Specifically, the first roller disposed upstream to the printing head 8 in the conveyance direction A may be the driving roller 4 that is rotationally driven by the conveyance motor 22, while the second roller disposed downstream to the printing head 8 in the conveyance direction A may be the driven roller 3 that rotates in accordance with the rotation of the conveyance belt 5 caused by the rotational drive of the first roller. With such a configuration, the control unit 14 rotates the conveyance belt 5 by rotationally driving the driven roller 3 and when the belt tension at the end of the print pause period has changed from the belt tension at the completion of printing of the first image due to the reverse rotation operation performed during the print pause period, the control unit 14 performs the correction so as to increase the rotation amount of the conveyance belt 5 in the first rotation direction during printing of the second image. When the roller on the downstream side in the conveyance direction A is the driving roller, as a result of the conveyance belt 5 being rotated in reverse during the print pause period, the belt tension tends to increase and the conveyance amount tends to decrease as the medium M is conveyed to print the second image. Thus, with such a configuration, by performing the correction so as to increase the rotation amount of the conveyance belt 5 in the first rotation direction during printing of the second image, it is possible to prevent the medium M from being conveyed by less than the appropriate amount during printing of the second image.

Further, in the printing apparatus 1 of the above-described embodiment, although the configuration is adopted in which the conveyance belt 5 is stretched over the two rollers, the conveyance belt 5 may be stretched over three or more rollers. In other words, a configuration may be adopted in which a third roller, a fourth roller and the like are provided in addition to the first roller and the second roller.

Next, an embodiment of a medium conveyance method performed using the printing apparatus 1 of the present embodiment will be described.

Figure 7:
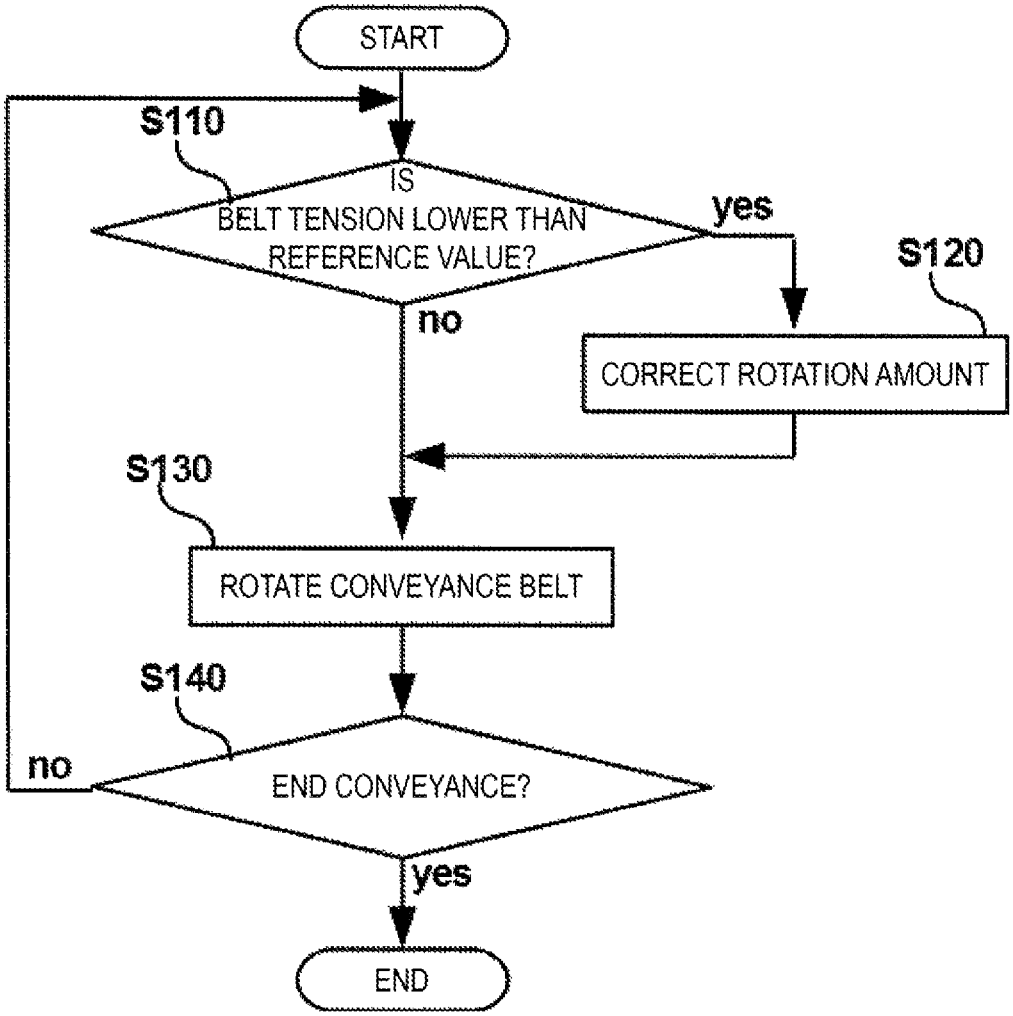
FIG. 7 is a flowchart illustrating a medium conveyance method performed using the printing apparatus according to an embodiment of the invention.

FIG. 7 is a flowchart of the medium conveyance method according to an embodiment performed using the printing apparatus 1 of the present embodiment.

The medium conveyance method of the embodiment is an example of the medium conveyance method that is performed when the printing is started after the so-called print pause period, which is the period lasting from the completion of printing of the first image to the start of printing of the second image to be printed subsequently to the first image.

When the medium conveyance method of the embodiment is started, at step S110, the control unit 14 first determines whether or not the reverse rotation operation has been performed during the print pause period. If the control unit 14 determines that the reverse rotation operation has not been performed during the print pause period, the control unit 14 then determines that the belt tension has not decreased with respect to the reference value Fmax and the method directly proceeds to step S130. On the other hand, if the control unit 14 determines that the reverse rotation operation has been performed during the print pause period, the control unit 14 verifies whether or not the belt tension has decreased with respect to the reference value Fmax. Specifically, the control unit 14 verifies the belt tension in the following manner. The control unit 14 determines the belt tension in the facing region on the basis of the operation timings of the forward rotation operation and the reverse rotation operation and the difference in the rotation amounts (the difference in the rotation amounts between the rotation amount of the conveyance belt 5 in the first rotation direction caused by the forward rotation operation and the rotation amount of the conveyance belt 5 in the second rotation direction caused by the reverse rotation operation) during the print pause period. Specifically, the rotation trajectories of the conveyance motor 22 (the rotation trajectories of the rotation of the conveyance motor 22 in the first rotation direction caused by the forward rotation operation and of the rotation of the conveyance motor 22 in the second rotation direction caused by the reverse rotation operation) are stored in the storage unit 18. At this step, the determination is made by calculating the belt tension on the basis of the rotation trajectories stored in the storage unit 18. Note that the belt tensions at the reference value Fmax and Fmin are also stored in the storage unit 18. Further, a table of the belt tensions corresponding to the differences in the rotation amounts, which are calculated on the basis of the rotation trajectory with reference to the belt tensions at Fmax and Fmin, is also stored in the storage unit 18.

Further, as described above, in the present embodiment, the net reverse rotation amount is used as the difference in the rotation amounts. The net reverse rotation amount is calculated by subtracting the rotation amount in the first rotation direction that contributes to the changes in the belt tension, of the rotation amount of the conveyance belt 5 in the first rotation direction during the print pause period, from the rotation amount in the second rotation direction that contributes to the changes in the belt tension, of the rotation amount of the conveyance belt 5 in the second rotation direction during the print pause period. In other words, the control unit 14 calculates the difference in the rotation amounts (the net reverse rotation amount) by taking into account only the rotation amount of the conveyance belt 5 that contributes to the changes in the belt tension and ignores the rotation amount of the conveyance belt 5 that does not contribute to the changes in the belt tension.

At step S110, if it is determined that the belt tension has decreased with respect to the reference value Fmax (when the net reverse rotation amount has been generated), the method proceeds to step S120 where the control unit 14 corrects the rotation amount of the conveyance motor 22 (the rotation amount of the conveyance motor 22 corresponding to the single intermittent conveyance) on the basis of the net reverse rotation amount (the difference in the rotation amounts). Then, the rotation amount corresponding to the single intermittent conveyance is added to the rotation amount of the conveyance motor 22 in the first rotation direction, which is stored in the storage unit 18 and the method proceeds to step S130.

On the other hand, at step S110, if it is determined that the belt tension has not decreased with respect to the reference value Fmax (when the net reverse rotation amount has not been generated), the method directly proceeds to step S130.

At step S130, the rotation of the conveyance belt 5 corresponding to the single intermittent conveyance is performed. Specifically, if the correction has been made to the rotation amount of the conveyance motor 22 at step S120, the rotation of the conveyance belt 5 on the basis of the corrected rotation amount of the conveyance motor 22 is performed, while if the correction has not been made, the rotation of the conveyance belt 5 on the basis of the predetermined rotation amount of the conveyance motor 22 is performed.

Then, the method proceeds to step S140 where it is determined whether or not the conveyance has ended as a result of the end of a recording operation or the like. If it is determined that the conveyance has ended, the medium conveyance method of the present embodiment is brought to an end, while if it is determined that the conveyance has not ended, the method returns to step S110 where steps S110 to S140 are repeated until it is determined that the conveyance has ended. Note that when steps S110 to S140 are repeated, the belt tension is determined at step S110 every time the steps are repeated. For each repeat, the rotation amount corresponding to the single intermittent conveyance is added to the rotation amount of the conveyance motor 22 in the first rotation direction, which is stored in the storage unit 18. This is because the correction value, which is applied to the rotation amount in the first rotation direction, varies each time. Specifically, in this configuration, the absolute correction value to be applied gradually decreases for each repeat. This is because the difference in the rotation amounts decreases by an amount corresponding to the single intermittent conveyance for each repeat, and accordingly, the difference between the belt tension and the reference value Fmax also decreases.

Specifically, the medium conveyance method of the present embodiment is a medium conveyance method in the printing apparatus 1 that includes the printing head 8 that can print the image on the medium M conveyed in the conveyance direction A, the driven roller 3 disposed upstream to the printing head 8 in the conveyance direction A, the driving roller 4 disposed downstream to the printing head 8 in the conveyance direction A, and the conveyance belt 5 that is stretched over the driven roller 3 and the driving roller 4 such that the tension is applied to the conveyance belt 5 between the driven roller 3 and the driving roller 4 and that can support the medium M at least in the facing region. With respect to the conveyance belt 5, the printing apparatus 1 can perform the forward rotation operation that can convey the medium M supported by the conveyance belt 5 in the conveyance direction A by rotating the conveyance belt 5 in the first rotation direction and the reverse rotation operation that can convey the medium M supported by the conveyance belt 5 in the reverse conveyance direction, which is the direction opposite to the conveyance direction A, by rotating the conveyance belt 5 in the second rotation direction, which is the direction opposite to the first rotation direction. Then, using the medium conveyance method, the printing apparatus 1 determines the belt tension in the facing region on the basis of the operation timings of the forward rotation operation and the reverse rotation operation during the print pause period, which is the period lasting from the completion of printing of the first image to the start of printing of the second image to be printed subsequently to the first image, and on the basis of the difference in the rotation amounts (the net reverse rotation amount) between the rotation amount of the conveyance belt 5 in the first rotation direction caused by the forward rotation operation and the rotation amount of the conveyance belt 5 in the second rotation direction caused by the reverse rotation operation (step S110) corrects the rotation amount of the conveyance belt 5 in the first rotation direction during printing of the second image (step S120). Specifically, if it is determined that the tension of the conveyance belt 5 has changed during the print pause period, the rotation amount of the conveyance belt 5 in the first rotation direction during printing of the second image is corrected. Thus, as a result of the correction, the error in the conveyance amount of the medium M that may occur as a result of rotating in reverse the conveyance belt 5 can be minimized.

Further, in other words, the medium conveyance method of the present embodiment is the medium conveyance method in the printing apparatus 1 that includes the printing head 8 that can print the image on the medium M conveyed in the conveyance direction A, the driven roller 3 disposed upstream to the printing head 8 in the conveyance direction A, the driving roller 4 disposed downstream to the printing head 8 in the conveyance direction A, and the conveyance belt 5 that is stretched over the driven roller 3 and the driving roller 4 such that the belt tension is applied to the conveyance belt 5 between the driven roller 3 and the driving roller 4 and that can support the medium M at least in the facing region that faces the printing head 8. With respect to the conveyance belt 5, the printing apparatus 1 can perform the forward rotation operation that can convey the medium M supported by the conveyance belt 5 in the conveyance direction A by rotating the conveyance belt 5 in the first rotation direction and the reverse rotation operation that can convey the medium M supported by the conveyance belt 5 in the reverse conveyance direction, which is the direction opposite to the conveyance direction A, by rotating the conveyance belt 5 in the second rotation direction, which is the direction opposite to the first rotation direction. Then, when the reverse rotation operation has been performed during the print pause period, which is the period from the completion of printing of the first image to the start of printing of the second image to be printed subsequently to the first image, and the belt tension at the end of the print pause period has changed from the belt tension at the completion of the printing of the first image due to the reverse rotation operation performed during the print pause period, the rotation amount of the conveyance belt 5 in the first rotation direction during printing of the second image is corrected (step S120). Thus, as a result of the correction, the error in the conveyance amount of the medium M that may occur as a result of rotating in reverse the conveyance belt 5 can be minimized.

Note that the invention is not intended to be limited to the above-mentioned examples, and many variations are possible within the scope of the invention as described in the appended claims. Of course, such variations will also fall within the scope of the invention. For example, in the printing apparatus 1 of the embodiment, although the configuration is adopted in which the conveyance motor 14 determines the net reverse rotation amount (the difference in the rotation amounts) and the belt tension on the basis of the rotation trajectories of the conveyance motor 22 stored in the storage unit 18, another configuration may be adopted in which the control unit 14 determines the net reverse rotation amount (the difference in the rotation amounts) and the belt tension on the basis of a measurement result of the belt tension measured by a separate sensor and the like.

This application claims priority under 35 U.S.C. § 119 to Japanese Patent Application No. 2018-051039, filed Mar. 19, 2018. The entire disclosure of Japanese Patent Application No. 2018-051039 is hereby incorporated herein by reference.

What is claimed is:

1. A printing apparatus comprising:

a printing unit configured to print an image on a medium conveyed in a conveyance direction;

a first roller arranged upstream of the printing unit in the conveyance direction;

a second roller arranged downstream of the printing unit in the conveyance direction;

a conveyance belt that is stretched over the first roller and the second roller such that a tension is applied to the conveyance belt between the first roller and the second roller, wherein the conveyance belt is configured to support the medium at least in a facing region facing the printing unit; and a control unit configured to perform on the conveyance belt a forward rotation operation configured to convey the medium supported by the conveyance belt in the conveyance direction by causing the conveyance belt to be rotated in a first rotation direction, and a reverse rotation operation configured to convey the medium supported by the conveyance belt in a reverse conveyance direction, which is an opposite direction to the conveyance direction, by causing the conveyance belt to be rotated in a second rotation direction, which is an opposite direction to the first rotation direction, wherein when the reverse rotation operation has been performed during a print pause period, which is a period after printing of a first image and prior to printing of a second image, and the tension of the conveyance belt has changed as a result of the reverse rotation operation, the control unit corrects a rotation amount of the conveyance belt in the first rotation direction during printing of the second image, wherein the corrected rotation amount corresponds to a change in tension of the conveyance belt.

2. The printing apparatus according to claim 1, wherein the control unit is configured to determine whether the tension is at a reference value and correct the rotation amount of the conveyance belt in the first rotation direction during printing of the second image, until the tension reaches the reference value.

3. The printing apparatus according to claim 2, wherein the control unit is configured to correct the rotation amount of the conveyance belt in the first rotation direction during printing of the second image based on a difference between the tension and the reference value.

4. The printing apparatus according to claim 2, wherein the control unit is configured to obtain a net reverse rotation amount by subtracting the rotation amount in the first rotation direction that contributes to changes in the tension of the rotation amount of the conveyance belt in the first rotation direction during the print pause period, from the rotation amount in the second rotation direction that contributes to changes in the tension of the rotation amount of the conveyance belt in the second rotation direction during the print pause period, and determine whether the net reverse rotation amount at the end of the print pause period is at a reverse rotation saturation amount at which the changes in the tension due to the reverse rotation operation reach saturation.

5. The printing apparatus according to claim 4, wherein when the control unit determines that the net reverse rotation amount is not at the reverse rotation saturation amount, the control unit corrects the rotation amount of the conveyance belt in the first rotation direction during printing of the second image in accordance with the net reverse rotation amount.

6. The printing apparatus according to claim 4, wherein when the control unit determines that the net reverse rotation amount is at the reverse rotation saturation amount, the control unit corrects the rotation amount of the conveyance belt in the first rotation direction during printing of the second image by a predetermined amount corresponding to the reverse rotation saturation amount.

7. The printing apparatus according to claim 1, wherein the second roller is a driving roller rotationally driven by a motor, the first roller is a driven roller rotated in accordance with the rotation of the conveyance belt caused by the rotational drive of the second roller, the control unit causes the conveyance belt to rotate by causing the second roller to be rotationally driven, and when the tension at the end of the print pause period has changed from the tension when the printing of the first image is complete due to the reverse rotation operation performed during the print pause period, the control unit performs the correction to reduce the rotation amount of the conveyance belt in the first rotation direction during printing of the second image.

8. The printing apparatus according to claim 1, wherein the first roller is a driving roller rotationally driven by a motor, the second roller is a driven roller rotated in accordance with the rotation of the conveyance belt caused by the rotational drive of the first roller, the control unit causes the conveyance belt to rotate by causing the first roller to be rotationally driven, and when the tension at the end of the print pause period has changed from the tension when the printing of the first image is complete due to the reverse rotation operation performed during the print pause period, the control unit performs correction to increase the rotation amount of the conveyance belt in the first rotation direction during printing of the second image.

9. A medium conveyance method in a printing apparatus including a printing unit configured to print an image on a medium conveyed in a conveyance direction, a first roller arranged upstream of the printing unit in the conveyance direction, a second roller arranged downstream of the printing unit in the conveyance direction, and a conveyance belt that is stretched over the first roller and the second roller such that a tension is applied to the conveyance belt between the first roller and the second roller and that is configured to support the medium at least in a facing region facing the printing unit, the printing apparatus being configured to perform on the conveyance belt a forward rotation operation configured to convey the medium supported by the conveyance belt in the conveyance direction by causing the conveyance belt to be rotated in a first rotation direction, and a reverse rotation operation configured to convey the medium supported by the conveyance belt in a reverse conveyance direction, which is an opposite direction to the conveyance direction, by causing the conveyance belt to be rotated in a second rotation direction, which is an opposite direction to the first rotation direction, the medium conveyance method comprising:

correcting a rotation amount of the conveyance belt in the first rotation direction during printing of a second image, when the reverse rotation operation has been performed during a print pause period, which is a period after printing of a first image and prior to printing of the second image, and the tension of the conveyance belt has changed as a result of the reverse rotation operation, wherein the corrected rotation amount corresponds to a change in tension of the conveyance belt.

* * * * *